US006173144B1

(12) United States Patent
Hirabayashi et al.

(10) Patent No.: US 6,173,144 B1
(45) Date of Patent: Jan. 9, 2001

(54) IMAGE FORMING APPARATUS WHICH SUPPLIES IMAGE BEARING MEMBER WITH ELECTRICALLY CONDUCTIVE PARTICLES DURING DEVELOPMENT

(75) Inventors: Jun Hirabayashi; Harumi Ishiyama, both of Numazu; Yasunori Chigono, Susono; Seiichi Shinohara, Abiko, all of (JP)

(73) Assignee: Canon Kabushiki Kaisha, Tokyo (JP)

( * ) Notice: Under 35 U.S.C. 154(b), the term of this patent shall be extended for 0 days.

(21) Appl. No.: 09/390,647

(22) Filed: Sep. 7, 1999

(30) Foreign Application Priority Data

Sep. 4, 1998 (JP) ..... 10-267398

(51) Int. Cl.[7] ..... G03G 15/00; G03G 15/02; G03G 15/08

(52) U.S. Cl. ..... 399/222; 399/43; 399/149; 399/174; 430/110

(58) Field of Search ..... 399/38, 43, 149, 399/150, 174, 175, 176, 222, 252, 55; 430/110, 120

(56) References Cited

U.S. PATENT DOCUMENTS

| | | | | |
|---|---|---|---|---|
| 5,432,037 | | 7/1995 | Nishikiori et al. | 430/126 |
| 5,809,379 | | 9/1998 | Yano et al. | 399/159 |
| 5,915,150 | * | 6/1999 | Kukimoto et al. | 399/149 |
| 5,922,500 | * | 7/1999 | Iida et al. | 430/110 |
| 5,933,681 | * | 8/1999 | Suzuki | 399/150 X |

FOREIGN PATENT DOCUMENTS

| | | | |
|---|---|---|---|
| 7-99442 | | 10/1995 | (JP) . |
| 11-072991 | * | 3/1999 | (JP) . |
| 11-149205 | * | 6/1999 | (JP) . |

* cited by examiner

*Primary Examiner*—Sophia S. Chen
(74) *Attorney, Agent, or Firm*—Fitzpatrick, Cella, Harper & Scinto

(57) ABSTRACT

An image forming apparatus includes an image bearing member, a charging unit for charging the image bearing member, an image forming unit for forming an electrostatic image on the image bearing member charged by the charging unit, a developing device for developing the electrostatic image on the image bearing member and for supplying to the image bearing member charging performance enhancing particles which have a polarity opposite from that of the toner, wherein the developing device has a developer carrying member, opposed to the image bearing member, for carrying the toner and charging performance enhancing particles and also which forms an alternating electric field between the developer carrying member and the image bearing member to supply the toner and the charging performance enhancing particles to the image bearing member. A time duration for supplying the charging performance enhancing particles is longer than a time duration for supplying the toner, in an on period of the alternating electric field.

11 Claims, 6 Drawing Sheets

FIG.2(a) EMB. 1

FIG.2(b) COMP. EX. 1

FIG.2(c) COMP. EX. 2

IMAGE FORMING APPARATUS WHICH SUPPLIES IMAGE BEARING MEMBER WITH ELECTRICALLY CONDUCTIVE PARTICLES DURING DEVELOPMENT

FIELD OF THE INVENTION AND RELATED ART

The present invention relates to an image forming apparatus such as a copying machine or a printer which employs an electrophotographic system, an electrostatic recording system, or the like.

In the past, a corona type charging apparatus (corona discharging device) has been used as a charging apparatus for charging an image bearing member, for example, an electrophotographic photosensitive member, an electrostatically recordable dielectric member, or the like, in an image forming apparatus, for example, an electrophotographic image forming apparatus, an electrostatic recording apparatus, or the like, to predetermined polarity and potential level.

A corona discharging apparatus is a noncontact type charging apparatus. It comprises an ion discharging electrode constituted of, for example, a piece of wire or the like, and an electrode in the form of a shield which surrounds the ion discharging electrode. The shield electrode is provided with an ion discharging opening directed toward the surface of an object to be charged, but, not in contact with the object. In operation, high voltage is applied to the ion discharging electrode and the shield electrode to generate discharge current (corona shower) to which the surface of the object is exposed to be charged to predetermined polarity and potential level.

In recent years, however, a substantial number of contact type charging apparatuses have been proposed, and some of them have been put to practical use as a charging apparatus for charging an object such as an image bearing member or the like because of their advantages over a corona type charging apparatus. For example, they are smaller in the amount of ozone production and power consumption.

A contact type charging apparatus includes an electrically conductive charging member in the form of, for example, a roller (charge roller), a fur brush, a magnetic brush, or a blade, which is placed in contact with a member to be charged, for example, an image bearing member or the like. In operation, charge bias, or electrical voltage with a predetermined potential level, is applied to the contact charging member (contact type charging member, contact type charging device, or the like, which hereinafter will be referred to as a contact type charging member), which is placed in contact with a member to be charged, for example, an image bearing member or the like, so that the peripheral surface of the object to be charged is charged to predetermined polarity and electrical potential.

The charging mechanism (charging principle) in a contact type charging apparatus comprises a mixture of two charging mechanism: (1) a mechanism based on electrical discharge, and (2) a mechanism based on direct injection of electrical charge. Thus, the characteristics of a contact type charging apparatus vary depending on which of the two mechanisms is dominant.

(1) Charging Mechanism based on Electrical Discharge

This is a charging mechanism which charges the peripheral surface of an object to be charged, with the use of the electrical discharge which occurs across a microscopic gap between a contact type charging member and the object to be charged.

In a charging system based on electrical discharge, there is a threshold voltage value above which electrical discharge occurs between a contact type charging member and an object to be charged. Thus, in order for an object to be charged to a predetermined potential level, voltage, the potential level of which is greater than the predetermined voltage level, must be applied to a contact type charging member. In addition, an electrical discharge based charging system inherently produces by-products, the amount of which, however, may be extremely small compared to those produced by a corona based charging device. Therefore, even if a contact type charging system is employed, it is impossible to completely avoid the problems caused by active ions such as ozone.

(2) Mechanism Based on Electrical Charge Injection

This is a charging system which directly injects electrical charge into an object from a contact type charging member so that the peripheral surface of the object is electrically charged. It is called the direct charging system or the injection charging system. It also it called the charging injection charging system.

More specifically, a contact type charging member, the electrical resistance of which is in a medium range, is placed in contact with the peripheral surface of an object to be charged, to charge the object without triggering the electrical discharge. In other words, this charging mechanism is a charging mechanism which directly injects electrical charge into the peripheral surface of an object to be charged. In principle, it does not rely on electrical discharge. Therefore, even if the potential level of the voltage applied to a contact type charging member is less than a threshold voltage level, the object to be charged can be charged to a potential level substantially equal to the potential level of the applied voltage. Since this direct injection charging system does not involve ion generation, it does not suffer from the ill effects associated with the by-products of electrical discharge.

However, since a contact type charging system is a system based on charging injection, its performance is greatly affected by the state of contact between a contact type charging member and an object to be charged. Thus, it is very important that a contact type charging member is high in density, that there is provided a sufficient amount of difference in surface velocity between the charging member and the object to be charged, and that the contact type charging member makes contact with the object to be charged, with a sufficiently high frequency.

A) Charging by Roller

Among various contact type charging apparatuses, those which employ a roller based charging system, in other words, those which employ an electrically conductive roller (charge roller) as a contact type charging member, are widely used, because of their safety in a charging operation.

In the case of a charging roller, the charging mechanism based on electrical discharge (1) is the dominant charging mechanism.

A charge roller is formed of rubber or foamed material which is electrically conductive, or the electrical resistance of which is in the medium range. Sometimes, different materials are layered in order to obtain a predetermined characteristic.

A charge roller is provided with elasticity so that a predetermined state of contact can be kept between the charge roller and an object to be charged (hereinafter, photosensitive member). Therefore, a charger roller has a large frictional resistance on its peripheral surface. Generally, it is enabled to follow the rotation of a photosensitive member, or is driven at a speed slightly different from that of the photosensitive member. Thus, when a charge roller is used to directly inject electrical charge into a photosensitive member, it cannot be avoided that the charge roller is deteriorated in its absolute performance and/or the state of contact between itself and the photosensitive member by the contaminants adhered to the charge roller and/or the photosensitive member. As a result, the photosensitive member is nonuniformly charged, in spite of the fact that a charge roller is a contact type charging member. In other words, in the case of a conventional charging roller, the charging mechanism based on electrical discharge is dominant in charging the photosensitive member.

FIG. 6 is a graph which shows the efficiencies of various contact type charging members. The abscissa represents the potential level of the bias applied to a contact type charging member, and the ordinate represents the correspondent potential level of a photosensitive member.

The characteristic of a conventional charge roller is depicted by line A. In other words, the charging of the photosensitive drum begins when the potential level of the voltage applied to the charge roller passes the threshold value of approximately −500 V. Therefore, generally, in order to charge a photosensitive drum to a potential level of −500 V, either a DC voltage of −1000 V is applied to the charge roller, or an AC voltage with a peak-to-peak voltage of 1200 V is applied to the charge roller, in addition to a DC voltage of −500 V, so that a difference in potential level greater than the threshold voltage value is always present between the charge roller and the photosensitive drum, and the potential level of the photosensitive drum converges to the predetermined potential level, −500 V.

To describe in more detail, when a charge roller is placed in contact with a photosensitive drum with a 25 $\mu$m thick photoconductor layer, the surface potential level of the photosensitive drum begins to rise as the potential level of the voltage applied to the charge roller is increased beyond approximately 640 V. Beyond 640 V, the surface potential level of the photosensitive drum linearly increases at an inclination of 1. This threshold potential level is defined as a charge initiation voltage Vth.

In other words, in order to increase the surface potential level of a photosensitive drum to a potential level of Vd, a DC voltage with a potential level of Vd+Vth, which is greater than the target surface potential level for the photosensitive drum, is necessary. This method in which only DC voltage is applied to a contact type charging member to charge an object is called a DC charge system.

However, it is rather difficult to change the value of the potential level of a photosensitive member to a desired level with the use of a DC charge system, because the resistance value of a contact type charging member varies, due to changes in ambience, and also because the value of Vth changes as the thickness of the surface layer of the photosensitive member changes as it is shaved.

Thus, various proposals to uniformly and reliably charge a photosensitive drum have been made. Among such proposals, U.S. Pat. No. 4,851,960 discloses an AC charge system, according to which a compound voltage comprises a DC voltage equivalent to a desired potential level Vd and an AC voltage with a peak-to-peak voltage of 2×Vth is applied to a contact type charging member. This proposal intended that AC voltage be used to make the potential level uniform. As a result, the potential level of an object to be charge converges to the voltage value of Vd, i.e., the center of the top and bottom peaks of the AC voltage, which is not affected by external disturbance such as changes in ambience.

However, even in the case of such a contact type charging apparatus as the one described above, its primary charging mechanism is a charging mechanism based on electrical discharge, that is, its charging mechanism principally relies on the electrical discharge which occurs between a contact type charging member and a photosensitive member. Therefore, the potential level of the voltage applied to a contact type charging member needs to have a value greater than the value of the potential level to which a photosensitive drum is to be charged. As a result, ozone is produced, although the amount is microscopic.

Further, when an AC charge system is used for the uniformity of charge, an additional amount of ozone is generated, and the contact type charging member and the photosensitive member are vibrated by the electric field generated by the AC voltage, which results in noises (AC charge noises). Further, the deterioration or the like of the peripheral surface of the photosensitive drum is very severe. These are new problems.

B) Charging by Fur Brush

In this charging method, a member with a brush portion formed of electrically conductive fibrous material is used as a contact type charging member (fur brush type charging device). In operation, the brush portion formed of electrically conductive fibrous material is placed in contact with a photosensitive member as an object to be charged, and charge bias with a predetermined potential level is applied to the brush portion to charge the peripheral surface of the photosensitive drum to predetermined polarity and potential level.

Also in the case of this fur brush type charging system, the dominant charging mechanism is the aforementioned charging mechanism based on electrical discharge (1).

There are two fur brush type charging devices which have been put to practical use: a fixed type, and a roller type. The former comprises a pile segment provided by weaving fibrous material with an electrical resistance in an intermediary range, into base cloth, and attaching electrodes to the pile, whereas the latter comprises a metallic core and a piece of pile, similar to the one for the fixed fur brush type charging device, wrapped around the metallic core. As for the pile, those with a fiber density of approximately 100 strands/mm$^2$ can be relatively easily obtainable. However, in order to charge a photosensitive member in a sufficiently uniform manner by the injection of electrical charge, such a fiber density is not high enough to maintain a satisfactory state of contact between the charging member and the photosensitive drum. Thus, it is necessary to provide between the peripheral surfaces of the charging member and photosensitive member such a velocity difference that is impossible to mechanically realize, which is not practical.

The characteristics of a fur brush type charging device when DC voltage is applied are depicted by line B in FIG. 6. In other words, also in the case of a fur brush type charging device, whether it is of a fixed type or a roller type, a photosensitive drum is charged mostly through electrical discharge generated by the application of charge bias with a potential level higher than the target potential level.

C) Charging by Magnetic Brush

In this charging method, a member (charging device which employs magnetic brush) with a magnetic brush portion, that is, electrically conductive magnetic particles magnetically confined in the form of a brush on a magnetic roller or the like, is used as a contact type charging member. In operation, the magnetic brush portion is placed in contact with a photosensitive member, and charge bias with a predetermined potential level is applied to charge the peripheral surface of the photosensitive drum as an object to be charged, to predetermined polarity and potential level.

In the case of a magnetic brush type charging device, the dominant charging mechanism is the injection charging mechanism (2).

When electrically conductive magnetic particles ranging 5–50 $\mu$m in diameter are used to form the magnetic brush portion, and a sufficient amount of difference in peripheral surface velocity is provided between the magnetic brush portion and a photosensitive drum, the photosensitive drum can be uniformly charged by the charge injection.

As is depicted by line C in FIG. 6, this magnetic brush type charging device can charge a photosensitive drum to a potential level substantially proportional to the potential level of the bias applied to a charging member.

However, this device also has its own problems. For example, it is complicated in structure, and some of the electrically conductive magnetic particles, of which the magnetic brush portion is provided, fall off and adhere to a photosensitive drum.

U.S. Pat. No. 5,809,379 or the like discloses a method for charging a photosensitive drum by directly injecting electrical charge into the charge retaining portions, for example, the traps in the peripheral surface, or electrically conductive particles in the charge injection layer, of the photosensitive drum. This method does not rely on electrical discharge. Therefore, the potential level of the voltage to be applied to a charging member by this method has only to be as high as the potential level to which the photosensitive drum is charged, and also, it does not generate ozone. Further, it does not require the application of AC voltage. Therefore, there is no charging noise. In other words, this method is a superior charging method to a roller type charging method in that it does not produce ozone, and consumes a smaller amount of electrical power.

D) Cleaner-less System (Toner Recycling System)

In a transfer type image forming apparatus, the developing agent (toner) which remains on a photosensitive member (image bearing member) after image transfer, i.e., transfer residual developing agent (transfer residual toner), is removed from the peripheral surface of the photosensitive member by a cleaner (cleaning apparatus) and becomes waste toner. From the standpoint of environmental protection, it is desired that waste toner is not produced. Thus, a cleaner-less image forming apparatus has been realized. In this type of an image forming apparatus, there is no cleaner, and the transfer residual developer which remains on a photosensitive member after image transfer is removed from the photosensitive member by a developing apparatus (developing-cleaning process). In other words, the residual toner is recovered by the developing apparatus to be recycled.

The developing-cleaning process is a process in which the developer remaining on a photosensitive member after image transfer is recovered by a fog removal bias (difference Vback between potential level of DC voltage applied to developing apparatus and potential level of peripheral surface of photosensitive drum) during the development of a latent image which follows image transfer. More specifically, in the immediately following image formation cycle, the photosensitive member is charged. The transfer residual developer from the preceding image formation cycle remaining thereon, and is exposed to form a latent image. Then, the transfer residual developer from the preceding image formation cycle is recovered in this image formation cycle. According to this method, the transfer residual developer is recovered by a developing apparatus and is used in the following image formation cycles. In other words, waste toner is not produced, reducing the amount of maintenance labor. Further, being cleaner-less makes a cleaner-less recording apparatus advantageous in terms of space; a cleaner-less recording apparatus can be remarkably smaller compared to a recording apparatus with a cleaner.

In a cleaner-less system, the residual toner is passed through a charging means portion and then a developing apparatus, instead of being removed from the peripheral surface of a photosensitive member by a dedicated cleaner as described previously, so that it can be recycled to be used for the development processes in the following image formation cycles. Thus, a cleaner-less system has its own problem, that is, how to properly charge a photosensitive member, with developer which is electrically insulative, being present in the contact portion between the photosensitive member and a contact type charging member. When a photosensitive member is charged by a roller type charging member or a fur brush, the transfer residual toner on the photosensitive member is evenly scattered to remove the patterns in which the residual toner was distributed, and the photosensitive member is charged mostly through the electrical discharge caused by the application of relatively large bias. On the other hand, a magnetic brush type charging member has an advantage over a roller in that when it is used to charge a photosensitive member, a brush portion comprising electrically conductive magnetic particles, that is, powder, flexibly contact the photosensitive member to charge it. However, a magnetic brush type charging member has its own problems. For example, it is complicated in structure, and the electrically conductive particles which form the magnetic brush portion fall from the magnetic type charging member.

E) Coating of Powder on Contact Type Charging Member

Japanese Patent Publication Application No. 99442/1995 discloses a structure for a contact type charging apparatus, which is for charging an object uniformly and reliably, that is, which can prevent an object from being nonuniformly charged. According to this structure, powder is placed in the contact surface between a contact type charging member and an object to be charged, in order to uniformly charge an object.

U.S. Pat. No. 5,432,037 also discloses an innovative image forming method which employs a contact type charging method. According to this patent, in order to prevent toner particles and/or microscopic silica particles from adhering to the surface of a charging means and interfering with the charging as an image forming cycle is repeated for a long period of time, electrically conductive particles, the average diameter of which is smaller than that of the developer particles, are mixed into developing agent.

Further, the applicants of the present invention have also proposed an innovative charging method which relies on charge injection. This method is disclosed in application Ser. No. 09/035,109. It uses charging performance enhancing particles.

A charging method which uses charging performance enhancing particles has various merits. However, as the amount of the electrically conductive particles falls below a certain level, or a critical level, an object to be charged is liable to be nonuniformly charged (electrically conductive particles are desired to be reliably supplied).

SUMMARY OF THE INVENTION

The primary object of the present invention is to provide an image forming apparatus in which the image bearing member is charged, with the presence of charging performance enhancing particles in the charging station.

Another object of the present invention is to provide an image forming apparatus capable of reliably supplying the charging station with charging performance enhancing particles.

According to an aspect of the present invention, there is provided an image forming apparatus which comprises an image bearing member; a charging means for charging said image bearing member; an image forming means for forming an electrostatic latent image on said image bearing member charged by said charging means; and a developing means for supplying said image bearing member with charging performance enhancing particles which are opposite in polarity to toner, while developing the electrostatic latent image on said image bearing member with the use of the toner; wherein said developing means squarely faces said image bearing member, and comprises a developer bearing member for bearing the toner and charging performance enhancing particles; wherein said developing means supplies said image bearing member with the toner and charging performance enhancing particles by forming an alternating electric field between said image bearing member and the developer bearing member; and wherein, the ratio of the length of time the charging performance enhancing particles are caused to jump, relative to the duration of a single cycle of the alternating electric field is greater than the ratio of the length of the time the toner is caused to jump, relative to the duration of a single cycle of the alternating electric field.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Hereinafter, the embodiments of the present invention will be described with reference to the appended drawings.

Figure 1:
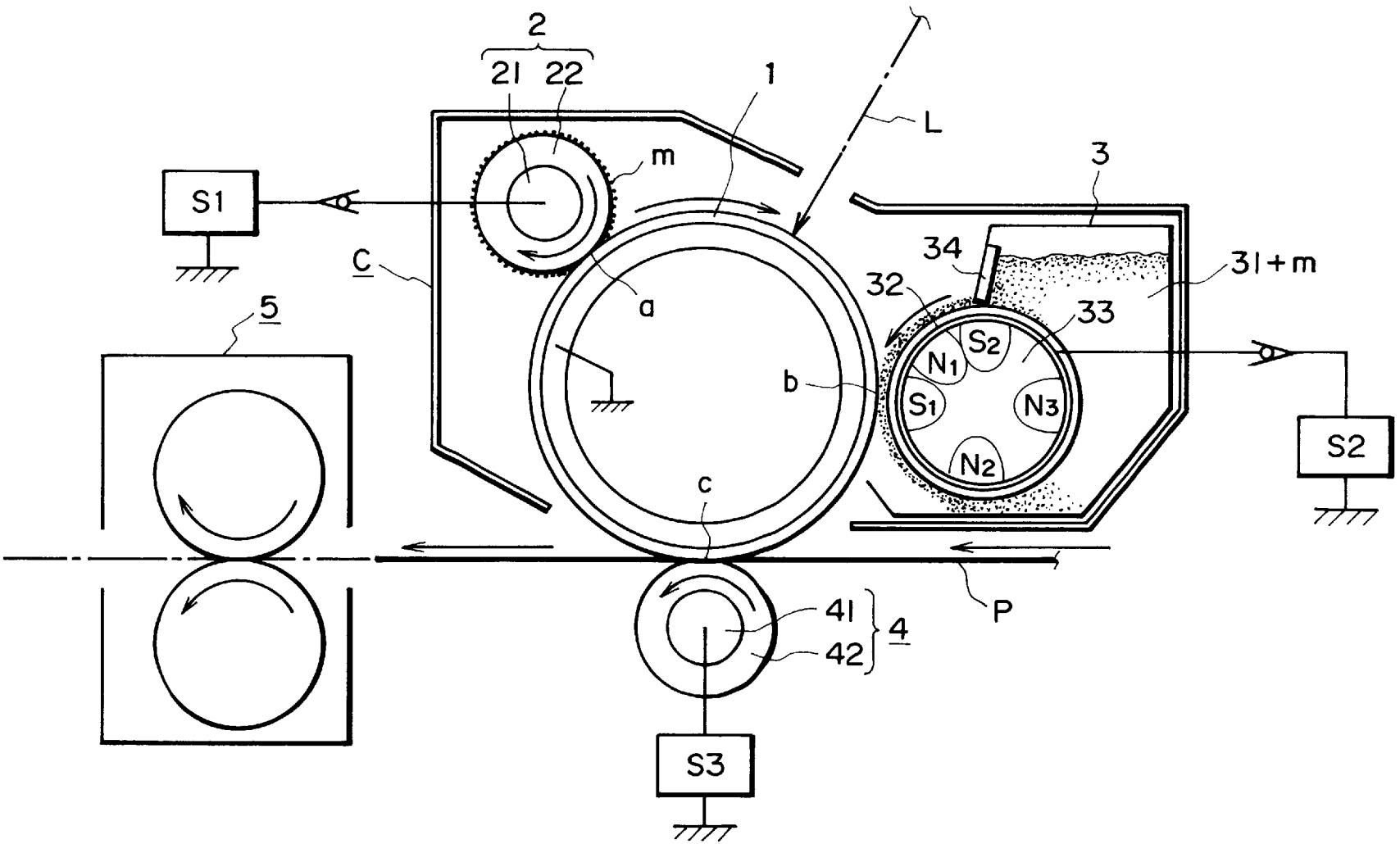
FIG. 1 is a schematic sectional view of the image forming apparatus in the first embodiment, and depicts the general structure of the image forming apparatus.

Embodiment 1 (FIG. 1)

FIG. 1 is a schematic sectional view of an image forming apparatus as an embodiment of the present invention.

The image forming apparatus in this embodiment is a cleaner-less laser printer which employs a transfer system, an electrophotographic process, a contact type charging system, a reversal developing system, and a process cartridge system.

(1) General Structure of Printer in this Embodiment

[Image Bearing Member]

A referential character 1 designates an electrophotographic photosensitive member in the form of a rotational drum as an image bearing member (object to be charged). The printer in this embodiment employs a reversal developing process. In other words, the photosensitive member in this embodiment is of a negative type. It is of an organic photoconductor type and is 30 mm in diameter. It is rotationally driven in the clockwise direction indicated by an arrow mark at a peripheral velocity of 94 mm/sec. In its surface layer, particles of zinc oxide are dispersed to improve its chargeability.

[Charging]

A referential character 2 designates an electrically conductive elastic sponge roller (charge roller) as a flexible contact type charging member, which is placed in contact with the photosensitive member 1 with the application of a predetermined amount of pressure. A referential character a designates a charging nip, i.e., the nip between the photosensitive member 1 and charge roller 2. The peripheral surface of the charge roller 2 is pre-coated with charging performance enhancing particles m, which are electrically conductive particles. Therefore, there are always the charging performance enhancing particles m in the charging nip a.

The charge roller 2 is rotationally driven in contact with the peripheral surface of the photosensitive member 1 at a peripheral velocity equal to 100% of the peripheral velocity of the photosensitive member 1, so that the moving direction of its peripheral surface in the charge nip a becomes opposite to that of the photosensitive member 1, and also so that there exists a certain amount of difference in peripheral velocity between the photosensitive member 1 and the charge roller 2.

To the charge roller 2, a predetermined charge bias is applied from a charge bias application power source S1. With this arrangement, the peripheral surface of the rotational photosensitive member 1 is uniformly charged to predetermined polarity and potential level. In other words, the peripheral surface of the photosensitive member 1 is charged by a mechanism which directly injects electrical charge with the use of a contact type charging member.

In this embodiment, charge bias is applied to the charge roller 2 from the charge bias power source S1 so that the peripheral surface of the photosensitive member 1 is uniformly charged to −700 V.

The charge roller 2, charging performance enhancing particles m, charge injection, and the like will be described in detail in separate sections.

The charged peripheral surface of the rotational photosensitive member 1 is exposed to a scanning laser beam L outputted from an unillustrated laser beam scanner which comprises a laser diode, a polygon mirror, and the like. The laser beam L is such a laser beam that is modulated in intensity with sequential electrical digital signals in accordance with the image data of a target original. As a result, an electrostatic latent image in accordance with the image data of the target image is formed on the peripheral surface of the rotational photosensitive member 1.

In this embodiment, a reversal developing process is employed. Therefore, the portions of the peripheral surface of the rotational photosensitive member 1 exposed by the scanning exposing beam L constitute the image portions, and unexposed portions constitute the background portions. The potential level of the exposed portion is approximately 0 V.

A referential character 3 designates a developing apparatus. The developing apparatus 3 in this embodiment is a reversal and noncontact type developing apparatus which uses a negatively chargeable developer 31, a magnetic and insulative developer constituted of a single kind of component. The average particle diameter of the developer 31 is 6 $\mu$m.

The aforementioned electrostatic latent image formed on the peripheral surface of the rotational photosensitive member 1 is reversely developed into an image comprising developer (toner image) by the developing apparatus 3. More specifically, the developer (toner) is adhered to the exposed portions of the peripheral surface of the photosensitive member 1 by the developing apparatus.

The developer 31 contains the charging performance enhancing particles m mixed into the developer at a ratio of 100 parts in weight of the developer 31 and 2 parts in weight of the charging performance enhancing particles m.

Designated by a reference character 32 is a nonmagnetic development sleeve with a diameter of 16 mm, and designated by a referential character 33 is a magnetic roller as a magnetic field generating means fixedly disposed in the development sleeve 32. Designated by a referential character 34 is an elastic blade for forming a thin layer of the developer on the peripheral surface of the development sleeve 32 by regulating the thickness of the layer of the developer as the developer is coated on the development sleeve.

The development sleeve 32 is disposed so that the shortest distance (hereinafter, distance between development sleeve 32 and photosensitive member 1) from its peripheral surface to the peripheral surface of the photosensitive member 1 becomes approximately 500 $\mu$m. It is rotationally driven about the longitudinal axial line of the fixedly disposed magnetic roller 33, at a constant velocity, so that the moving direction of its peripheral surface in the development station b becomes the same as the moving direction of the peripheral surface of the photosensitive member 1 in the development station b.

To the development sleeve 32, development bias, that is, electrical voltage, is applied from a development bias power source S2.

The developer 31 which contains the charging performance enhancing particles m is adhered in a layer to the peripheral surface of the development sleeve 32 by the magnetic force from the magnetic roller 33, forming a magnetic brush of developer 31. As the development sleeve rotates, the layer of the developer 31, i.e., the magnetic brush of the developer 31, is conveyed past the elastic blade 34. As the magnetic brush is passed by the elastic blade 34, the developer particles in the magnetic brush are triboelectrically charged by the elastic blade 34 while being regulated in its thickness by the elastic blade 34. Then, the layer of the developer 31, which at this point has a predetermined thickness, is conveyed to the development station b. In the development station b, as a predetermined development bias is applied to the development sleeve 32 by the power source S2, the developer particles in the developer layer jump from the development sleeve 32 to the photosensitive member 1 (single component jumping development). As the development sleeve 32 rotates further, the developer particles which were not used for development are carried back into the developer container to be recycled.

A referential character 4 designates a transfer roller as a contact type means for transferring an image. Its electrical resistance is in a medium range. It is placed in contact with the photosensitive member 1 with the application of a predetermined amount of pressure to form a transfer station c. To this transfer station c, a sheet of transfer medium P as a recording medium is delivered with a predetermined timing from an unillustrated sheet feeding station. As the transfer medium P is passed through the transfer station c, transfer bias, or electrical voltage with a predetermined potential level, is applied to the transfer roller 4 from a transfer bias power station 53. As a result, the developer image on the photosensitive member 1 is continuously transferred, starting from the leading end, onto the surface of the transfer medium P.

The transfer roller 4 employed in this embodiment comprises a metallic core 41, and an elastic layer 42 formed on the peripheral surface of the metallic core 41. The electrical resistance of the elastic layer 42 is in a medium range. In other words, the electrical resistance of the transfer roller 4 is $5\times10^8$ ohm. In order to transfer an image, a DC voltage of +3000 kV is applied to the metallic core 41 of the transfer roller 4. As the transfer medium P arrives at the transfer station c, it is pinched by the photosensitive member 1 and the transfer roller 4, that is, it is introduced into the transfer station c, in which the developer image borne on the peripheral surface of the photosensitive member 1 is continuously transferred, starting from its leading and, onto the surface of the transfer medium P, by the electrostatic force and mechanical pressure.

A referential character 5 designates a thermal fixing apparatus. After being delivered to the transfer station c, and receiving a developer image from the photosensitive member 1, the transfer medium P is separated from the photosensitive member 1 and is introduced into this fixing apparatus 5, in which the developer image is fixed to the transfer as a copy or a print from the image forming apparatus.

The printer in this embodiment employs a cartridge C which comprises three processing devices: the photosensitive member 1, charge roller 2, and developing apparatus 3, and a cartridge shell in which the three devices are integrally disposed. The cartridge C is removably installable in the main assembly of the image forming apparatus. The combination of the processing devices integrally disposed in a process cartridge is not limited to the aforementioned one.

(2) Charge Roller 2

The charge roller 2 as an elastic contact type charging member in this embodiment comprises a metallic core 21, and a layer 22 of rubber or foamed material, coated on the peripheral surface of the metallic core 21. The electrical resistance of the elastic layer is in a medium range.

More specifically, the intermediate resistant layer 22 is formed of resin (in this embodiment, urethane), which contains electrically conductive particles (for example, carbon black particles), and is treated with a sulfurizing agent, a foaming agent, and the like. It is in the form of a cylindrical roller filled around the metallic core 21. After the coating, the peripheral surface of the intermediately resistant layer 21 is polished.

It is very important that the charge roller 2, a contact type charging member, also functions as an electrode. In other words, not only must the charge roller 2 be provided with a sufficient amount of elasticity so that it creates and maintains a satisfactory state of contact between itself and an object to be charged, but also it must be low in electrical resistance so that a moving object can be charged to a satisfactory potential level. On the other hand, the charge roller 2 must be capable of preventing a voltage leak which might occur if an object to be charged has defects in terms of voltage resistance such as a pin hole. Thus, when an object to be charged is an electrophotographic photosensitive member, the electrical resistance of the charge roller 2 is desired to be in a range of $10^4$–$10^7$ ohm so that the object can be satisfactorily charged while preventing a voltage leak.

The peripheral surface of the charge roller 2 is desired to be provided with microscopic irregularities so that it can hold charging performance enhancing particles m.

As for the hardness of the charge roller 2, if the charge roller 2 is extremely low in hardness, it is unstable in terms of shape, failing to maintain the satisfactory state of contact between itself and an object to be charged, whereas if it is extremely high in hardness, not only does it fail to create a satisfactory charging nip a between itself and the object to be charged, but also it is inferior in the state of contact, in terms of a microscopic level, between itself and the object to be charged. Therefore, the hardness of the charge roller 2 is desired to be in a range of 25 deg. to 50 deg. in Asker C hardness scale.

The material for the charge roller 2 does not need to be limited to foamed elastic material. For example, material provided by dispersing an electrically conductive substance such as carbon black, metallic oxide, and the like into elastic material, for example, EPDM, urethane, NBR, silicone rubber, IR, or the like to adjust the electrical resistance of the latter, as well as the foamed form of the thus formed material, may be used as the material for the charge roller 2. Further, instead of dispersing an electrically conductive substance into the base material, ion conductive material may be used to adjust the electrical resistance of the material for the charge roller 2.

The charge roller 2 is pressed upon the photosensitive member 1 as an object to be charged, with the application of a predetermined amount of pressure, so that the charge nip a with a width of several millimeters (in this embodiment) is formed between the peripheral surfaces of the charge roller 2 and the photosensitive member 1 due to the elasticity of the surface layer of the charge roller 2.

The resistance value of the charge roller 2 was measured in the following manner. First, the photosensitive member 1 of the printer was replaced with an aluminum drum. Then, the current which flowed between the aluminum drum and the metallic core 21 of the charge roller 2 when a voltage of 100 V was applied between the aluminum drum and the metallic core 21 was measured. Then, the resistance value of the charge roller 2 was obtained from the measured current value.

The resistance value of the charge roller 2 in this embodiment obtained in the above-described manner was $5\times10^6$ ohm. The measurement was made in an environment which was 25° C. in temperature and 60% in humidity.

The average cell diameter of the peripheral surface of the charge roller 2 was 20 $\mu$m. The average cell diameter was obtained through observation with the use of an optical microscope.

(3) Charging Performance Enhancing Particles m

In this embodiment, particles of zinc oxide which is electrically conductive were used as the charging performance enhancing particles m to be coated in advance on the peripheral surface of the charge roller 2, and the charging performance enhancing particles m to be added to the developer 31 in the developing apparatus 3. The specific resistivity and average particle diameter of the zinc oxide particles were $10^7$ ohm and 1 $\mu$m, respectively.

It does not matter whether the charging performance enhancing particles are in the form of a primary particle, that is, an individual particle, or a secondary particle, that is, a particle comprising multiple primary particles. In other words, as long as the charging performance enhancing particles function as expected, the state of their aggregation does not matter.

When each charging performance enhancing particle is in the form of an aggregate of multiple primary charge performance enhancing particles, the average diameter of the charging performance enhancing particles was defined as the average diameter of the charging performance enhancing particles in the form of the aggregate. As for the method used for measuring the particle diameter, no fewer than 100 charging performance enhancing particles were selected, and their maximum horizontal cord lengths were measured with the use of an optical or electron microscope. Then, the volumetric particle diameter distribution was calculated based on the results of the measurement. Then, the 50% average particle diameter was used as the average particle diameter of the charging performance enhancing particle in this embodiment.

If the resistance value of the charging performance enhancing particles m is no less than $10^{12}$ ohm.cm, they are detrimental to the charging performance. Therefore, it must be no more than 10 ohm.cm, preferably, no more than $10^{10}$ ohm.cm. In this embodiment, the charging performance enhancing particles m with a resistance value of $1\times10^7$ ohm.cm were used.

The electrical resistance of the charging performance enhancing particle m was determined by measuring the electrical resistance of the charging performance enhancing particle m by a tablet method and normalizing the results of the measurement. More specifically, approximately 0.5 g of the powder sample was placed in a cylinder with a bottom surface area of 2.26 $cm^2$, and was compacted with a pressure of 15 kg through top and bottom electrodes. Then, the electrical resistance was measured while applying a voltage of 100 V. Then, the thus obtained resistance value was normalized to obtain the resistivity.

The charging performance enhancing particles are desired to be nonmagnetic white, or virtually transparent so that they do not interfere with the process for exposing the photosensitive member to form a latent image. Further, in consideration of the fact that some of the charging performance enhancing particles are transferred onto the recording medium P from a photosensitive member, the charging performance enhancing particles use din color recording are desired to be colorless or white.

Further, unless the average particle diameter of the charging performance enhancing particles m was no more than ½ the average particle diameter of the developer 31, the charging performance enhancing particles m sometimes blocked the exposure light. Thus, the average diameter of the charging performance enhancing particles m is desired to be no more than ½ the particle diameter of the developer 31. As for the smallest value acceptable for the particle diameter of the charging performance enhancing particles m, it seems to be 10 nm in consideration of the stability of the particles.

As for the material for the charging performance enhancing particles m, zinc oxide was used in this embodiment. However, the selection is not limited to this. In other words, particles of various electrically conductive substances may be used. They may be inorganic, organic, or a mixture of inorganic and organic particles. Further, they may be treated on their surfaces.

(4) Charging by Injection

1) With the positioning of the charging performance enhancing particles m in the charging nip a, that is, the contact surface between the photosensitive member 1 and charge roller 2, even a charge roller which is difficult to keep rotating in contact with the photosensitive member 1 while maintaining a predetermined difference in peripheral velocity between the peripheral surfaces of the charge roller 2 and photosensitive member 1, because of the friction between the peripheral surfaces of the charge roller 2 and photosensitive member 1, can be easily kept rotating in contact with the peripheral surface of the photosensitive member 1 while maintaining the predetermined difference in peripheral velocity between the charge roller 2 and photosensitive member 1. In addition, a much larger number of electrical connections are established between the peripheral surfaces of the charge roller 2 and photosensitive member 1 because of the presence of the particles m between the two surfaces.

Further, the provision of the difference in peripheral velocity between the charge roller 2 and photosensitive member 1 drastically increases the number of the charging performance enhancing particles m which contacts the photosensitive member 1 in the nip a between the charge roller 2 and photosensitive member 1, and the number of opportunities with which each charging performance enhancing particle contacts the photosensitive member 1 in the nip a between the charge roller 2 and photosensitive member 1, so that the number of electrical contacts between the charge roller 2 and photosensitive member 1 drastically increases. In addition, the charging performance enhancing particles m, which are present between the peripheral surfaces of the charge roller 2 and photosensitive member 1, rub the peripheral surface of the photosensitive member 1, leaving virtually no gap between the two surfaces. Therefore, electrical charge can be directly injected into the photosensitive member 1. In other words, when a proper amount of the charging performance enhancing particles are present between peripheral surfaces of the charge roller 2 and photosensitive member 1, it is the direct charge injection that is dominant in the process in which the photosensitive member 1 is charged though the contact between the photosensitive member 1 and the charge roller 2.

In the structure for providing the difference in peripheral velocity between the charge roller 2 and the photosensitive member 1, the charge roller 2 is rotationally driven independently from the photosensitive member 1. Preferably, the charge roller 2 is driven in the direction which makes the movement of its peripheral surface in the charging nip a opposite to the movement of the peripheral surface of the photosensitive member 1 in the charging nip a, so that the transfer residual developer, which is being carried on the photosensitive member 1 to the charging nip a, is temporarily picked up by the charge roller 2. Tis is because the temporary separation of the transfer residual toner on the photosensitive member 1 from the photosensitive member 1 by the movement of peripheral surface of the charge roller 2 counter to the movement of the peripheral surface of the photosensitive member 1 improves the efficiency with which the photosensitive member 1 is charged by the injection of electrical charge.

With the above described arrangement, a high level of charging efficiency which was impossible for a conventional charge roller or the like to attain, can be attained. As a result, it is possible to give the photosensitive member 1 electrical charge, the potential level of which is substantially equal to the potential level of the votlage applied to the charge roller 2.

Thus, even when the charge roller 2 is used as a contact type charging member, the potential level of the bias to be applied to the charge roller 2 to charge the photosensitive member 1 to a given potential level has only to be as high as the given potential level to which the photosensitive member 1 is required to be charged. In other words, according to this embodiment, it is possible to realize a safe and reliable contact type charging system or apparatus which does not rely on electrical discharge.

If the number of charging performance enhancing particles m between the photosensitive member 1 as an image bearing member and the charge roller 2 as a contact type charging member is extremely small, the lubricational effects of the charging performance enhancing particles m are insufficient. In other words, there is too much friction between the charge roller 2 and photosensitive member 1, and therefore, it is difficult to rotate the charge roller 2 while maintaining a predetermined difference in peripheral velocity between the charge roller 2 and photosensitive member 1. Thus, an extremely large torque is necessary. Moreover, if the charge roller 2 is forcefully rotated, the peripheral surfaces of the charge roller 2 and photosensitive member 1 are shaved. In addition, a smaller number of charging performance enhancing particles means a smaller number of opportunities for electrical contacts between the two components. Therefore, the photosensitive member 1 cannot be sufficiently charged. On the other hand, if the amount of the charging performance enhancing particles between the charge roller 2 and photosensitive member 1 is extremely large, the charging performance enhancing particles fall off from the charge roller 2 by a number large enough to have adverse effects upon image formation.

According to an experiment, the amount of the charging performance enhancing particles between the charge roller 2 and the photosensitive member 1 is desired to be no less than $10^3/mm^2$. If the amount is less than $10^3/mm^2$, the number of the electrical connections established between the charge roller 2 and photosensitive member 1 by the presence of the charging performance enhancing particles is not large enough to provide a sufficient amount of lubricational effect and also a sufficient number of opportunities for electrical contact between the two components; the particles do not function satisfactorily as expected.

More specifically, the amount of the charging performance enhancing particles between the charge roller 2 and photosensitive member 1 is desired to be in a range of $10^3$–$5\times10^5/mm^2$. If it is greater than $5\times10^5/mm^2$, the number of the charging performance enhancing particles which fall onto the photosensitive member 1 is extremely large, which underexposes the photosensitive member 1 regardless of the optical transmissivity of the charging performance enhancing particles themselves. When it is less than $5\times10^5/mm^2$, the amount of the charging performance enhancing particles which fall off from the charge roller 2 is small enough not to adversely affect the charging means performance. Since the number of the charging performance enhancing particles which fell onto the photosensitive member 1 when the number of the charging performance enhancing particles between the charge roller 2 and the photosensitive member 1 was in the aforementioned range was $10^2$–$10^5/mm^2$, an amount less than $10^5/mm^2$ is desired as the amount which does not adversely affect image formation.

Next, a method for measuring the amounts of the charging performance enhancing agent between the charge roller 2 and photosensitive member 1, and those on the photosensitive member 1 will be described. The amount of the charging performance enhancing particles between the charge roller 2 and photosensitive member 1 is desired to be directly measured in the charging nip n between the two components. However, as a given area of the peripheral surface of the photosensitive member 1 comes in contact with the charge roller 2, the majority of the charging performance enhancing particles which are present on this area are stripped away by the peripheral surface of the charge roller 2 which is moving in the direction opposite to the moving direction of the photosensitive member 1. Therefore, in this embodiment, the amount of the charging performance enhancing particles which were present on a given area of the peripheral surface of the charge roller 2 immediately before this area of the charge roller 2 came in contact with the photosensitive member 1 was regarded as the amount of the charging performance enhancing particles between the charge roller 2 and the photosensitive member 1. In an actual measurement, first, the rotation of the photosensitive member 1 and charge roller 2, and the application of charge bias to the charge roller 2 were stopped, and the peripheral surfaces of the photosensitive member 1 and charge roller 2 were photographed with the use of a video-microscope (OVM1000N: Olympus) and a digital still recorder (SR-3100: Deltis). More specifically, the charge roller 2 was pressed upon a piece of slide glass in the same manner as the charge roller 2 was pressed upon the photosensitive member 1, and no fewer than ten areas of the contact surface between the charge roller 2 and photosensitive member 1 were photographed through the slide glass with the video-microscope fitted with an object lens with 1000 times magnification. The obtained digital images were subjected to a binary process which used a certain threshold value, so that each image of the contact surface was divided into areas which contained a charging performance enhancing particle, and areas which contained no charging performance enhancing particle. Then, the number of the area with a charging performance enhancing particle was counted using an appropriate image processing software. The amount of the charging performance enhancing particles on the photosensitive member 1 was also measured using a method similar to the above described method. In other words, the peripheral surface of the photosensitive member 1 was photographic with the use of the same video-microscope, and the obtained photograph was subjected to the same process as the one described above.

2) In a cleaner-less image forming apparatus, the residual developer which remains on the peripheral surface of the photosensitive member 1 after image transfer is carried undisturbed to the charging nip a, i.e., the nip between the photosensitive member 1 and charge roller 2, as the peripheral surface of the photosensitive member 1 moves.

In this case, the pattern which the transfer residual developer forms on the photosensitive member 1 is disturbed in the charging nip a because the charge roller 2 and photosensitive member 1 are in contact with each other with the presence of the difference in peripheral velocity between the peripheral surfaces of the two components. Therefore, the pattern of the image formed in the preceding image forming cycle does not appear as a ghost in the image which is being formed in the following current image forming cycle.

3) After being carried to the charging nip a, the transfer residual developer adheres to the charge roller 2 and/or mixes into the particles on the charge roller 2. The conventional developer is insulative. Thus, the adhesion of the transfer residual developer to the charge roller 2 and/or the mixing of the transfer residual developer into the particles on the charge roller 2 constitute some of the causes of the insufficient charging of the photosensitive member 1.

Even in such a case, however, the presence of the charging performance enhancing particles m in the charging nip a, or the nip between the photosensitive member 1 and charge roller 2, allows the charge roller 2 and photosensitive member 1 to remain electrically in contact with each other while maintaining a proper amount of friction between them. As a result, the photosensitive member 1 is uniformly charged, continuously and reliably, to a satisfactory potential level through the direct charge injection by the charge roller 2 for a long period of time, requiring relatively low votlage and producing no ozone, in spite of the contamination of the charge roller 2 by the transfer residual developer.

4) After adhering to the charge roller 2 and/or mixing into the particles on the charge roller 2, the transfer residual developer is expelled gradually from the peripheral surface of the charge roller 2 onto the photosensitive member 1, and is moved by the movement of the peripheral surface of the photosensitive member 1 to the development station b, in which it is recovered by the developing apparatus at the same time as the developing apparatus develops the latent image on the photosensitive member 1 (developing-cleaning, i.e., toner recycling).

In this case, the presence of the charging performance enhancing particles m on the charge roller 2 weakens the adhesive force of the transfer residual developer which is adhering to the charge roller 2 and also the developer which has mixed into the particles on the charge roller 2, improving the efficiency with which the transfer residual toner is expelled from the charge roller 2 to the photosensitive member 1.

In the developing-cleaning process, the transfer residual toner is recovered into the developing apparatus by fog removal bias Vback, that is, the difference in potential level between the DC voltage applied to the developing apparatus and the peripheral surface of the photosensitive drum, during the latent image developing process in the immediately following image forming cycle in which the portion of the photosensitive drum, on which the transfer residual toner remains, is charged and exposed to form a latent image. In a reversal development such as the one used in this embodiment, the developing-cleaning process is carried out by the electric field for transferring toner from the "dark" potential portions of the photosensitive drum onto the development sleeve, and the electric field for adhering toner from the development sleeve onto the "light" potential portions of the photosensitive drum.

5) In addition, the presence of the charging performance enhancing particles m, which occurs because some of the charging performance enhancing particles m are adhered to the peripheral surface of the photosensitive member 1 and remain hereon, improves the efficiency with which the developer is transferred from the photosensitive member 1 to the transfer medium P.

(5) Suppliance of Charging Performance Enhancing Particles m to Charging Nip a from Developing Apparatus 3

Whether a sufficient amount of the charging performance enhancing particles m is placed in advance in the charging nip a, i.e., the nip between the photosensitive member 1 and charge roller 2, or coated in advance on the peripheral surface of the charge roller 2, it is inevitable that the charging performance of the charging apparatus sometimes declines due to the decline in the amount of the charging performance enhancing particles m in the charging nip a, i.e., the nip between the photosensitive member 1 and charge roller 2, which sometimes occurs as the usage of the apparatus continues.

Therefore, in this embodiment, the charging performance enhancing particles m, which becomes opposite in polarity from the toner as they are charged, are mixed in advance into the developer 31 in the developing apparatus 3, so that the charging performance enhancing particles m are supplied to the peripheral surface of the photosensitive member 1 from the developing apparatus 3, and then are supplied to the charging nip a, i.e., the nip between the peripheral surface of the photosensitive member 1 and the peripheral surface of the charge roller 2, carried by the peripheral surface of the photosensitive member 1.

Figure 2:
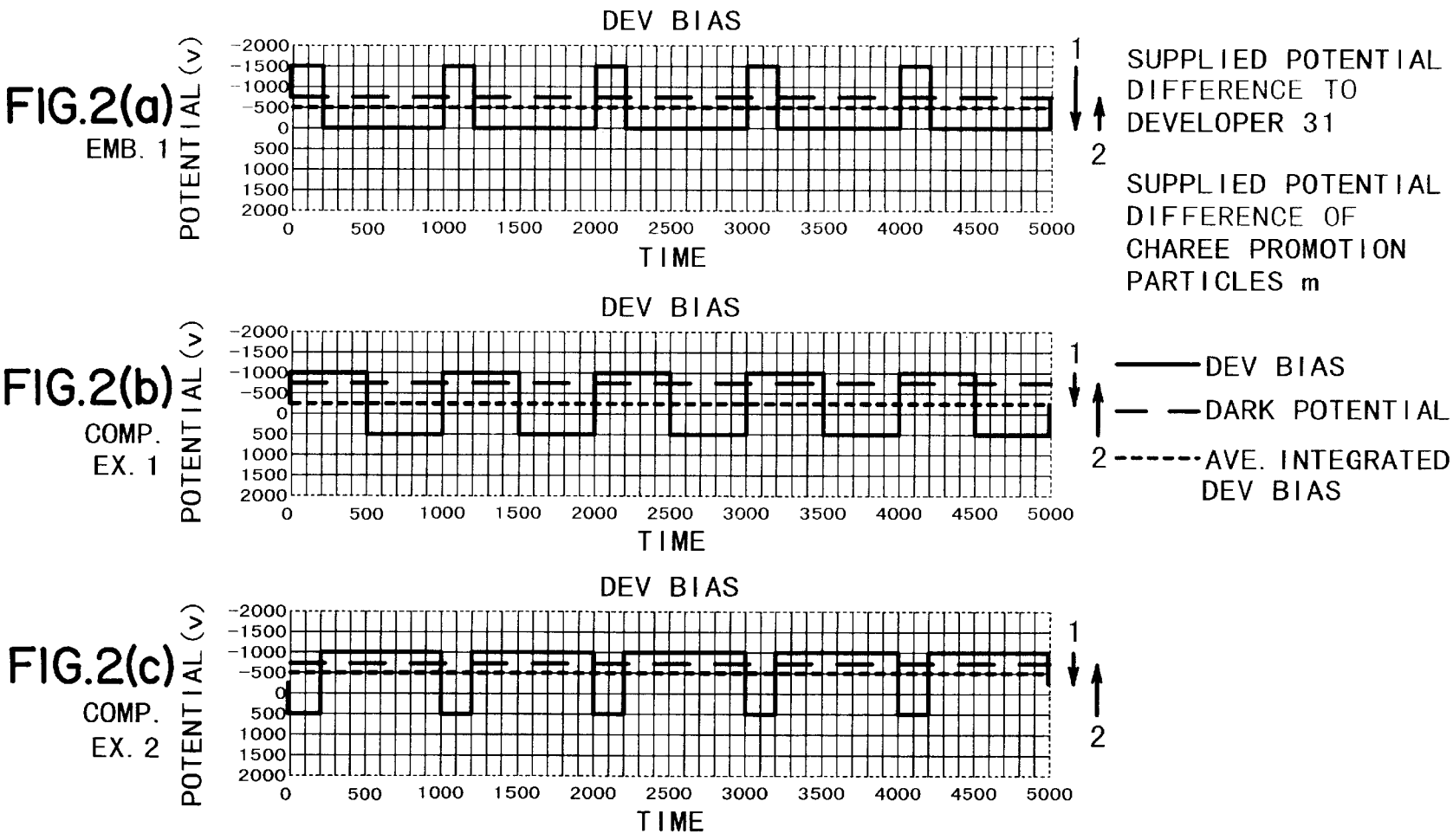
FIGS. 2 (*a, b* and *c*) are graphs which comparatively show the development biases in the first embodiment, and the first and second comparative examples.

The characteristic of the various biases, or electrical voltages, applied to the development sleeve 32 during a development process are shown in FIG. 2.

EMBODIMENT 1 (FIG. 2, (*a*))

The bias applied in this embodiment is long (75% of the duration of a single cycle of development bias) in the duration of the period in which the potential level of the bias is at a level at which the suppliance of the charging performance enhancing particles m from the developing apparatus 3 to the photosensitive member 1 is enhanced. In other words, the development bias applied in this embodiment is given a rectangular wave-form that makes the potential level difference for enhancing the suppliance of the charging performance enhancing particles m smaller in duty ratio than the potential level difference for enhancing the suppliance of the developer; the development bias is adjusted in integral average value to adjust the balance between the suppliance of the developer 31 and the charging performance enhancing particles m.

As described above, by forming an alternating electric field for development in the development station, the charging performance enhancing particles m can be supplied to the photosensitive member 1 at the same time as a latent image is developed by the toner.

Further, the occurrence of a problematic situation such that the charging performance of the charging apparatus declines as the charging performance enhancing particles are used up before the developer runs out, and the suppliance of the charging performance enhancing particles from within the developing apparatus to the charging nip stops, can be prevented by increasing the ratio of the duration of the time for causing the charging performance enhancing particles to jump, relative to the duration of a single cycle of the development electric field, compared to the ratio of the duration of the time for causing the toner to jump, relative to the duration of the same single cycle of the development electric field. With such an arrangement, the charging performance enhancing particles are supplied in a stable manner from the developing apparatus to the charging nip, making it possible to provide an image forming apparatus which is excellent in charging performance and is capable of reliably producing excellent images.

However, the above described arrangement may decrease the length of the time for causing the toner to jump, which in turn may make some image forming apparatuses insufficient in developer density.

If such a situation occurs, all that is necessary is to make the strength of the electric field for causing the toner to jump greater than that for causing the charging performance enhancing particles to jump.

As is described above, after the charging performance enhancing particles are supplied to the photosensitive drum, their polarity is opposite to that of the toner. Therefore, the charging performance enhancing particles are not transferred even when they are exposed to the transfer electric field. As a result, the charging performance enhancing particles are carried undisturbed to the charging station, in which they are supplied to the charge roller.

COMPARATIVE EXAMPLE 1 (FIG. 2, (*b*))

In this case, no duty is imposed on the development bias. Thus, the charging performance enhancing particles m and the developer 31 are equal in the length of the suppliance time (fifty—fifty in the length of the suppliance time in a single development bias cycle). They are also equal in the difference in the suppliance potential level.

COMPARATIVE EXAMPLE 2 (FIG. 2, (*c*))

In this case, the integral average value of the development bias is adjusted by using such a development bias that is short (25% in a single cycle of development bias) in the period in which the potential level of the development bias is at the level at which the suppliance of the charging performance enhancing particles m from the developing apparatus 3 to the photosensitive member 1 is enhanced, and that is imposed with a duty ratio which is greater in the potential level difference for enhancing the suppliance of the charging performance enhancing particles m than in the potential level difference for enhancing the suppliance of the developer.

The integral average value of the development bias is adjusted so that the outputted image density becomes the same.

In any of the above examples, the peak-to-peak votlage is 1.5 kV, and the frequency is 1.6 kHz.

The changes in the amount of the charging performance enhancing particles m supplied from the developing apparatus 3 to the peripheral surface of the photosensitive member 1 during a continuous printing operation was evaluated by using the following measuring method.

1) A standard image with an image ratio of 4% was continuously printed using an image forming apparatus which employed an image forming system in accordance with the present invention.

2) A blade was positioned immediately downstream of the charge roller 2. The peripheral surface of the photosensitive member 1 was observed in order to count the number of the charging performance enhancing particles m in a unit area, at a location immediately on the downstream side of the development station, with the use of an optical microscope, while printing the standard image, and while supplying the charging performance enhancing particles m only from the developing apparatus 3.

The amount of the charging performance enhancing particles m supplied from the developing apparatus 3 to the photosensitive member 1 was evaluated on the basis of the number of the counted charging performance enhancing particles m.

Figure 3:
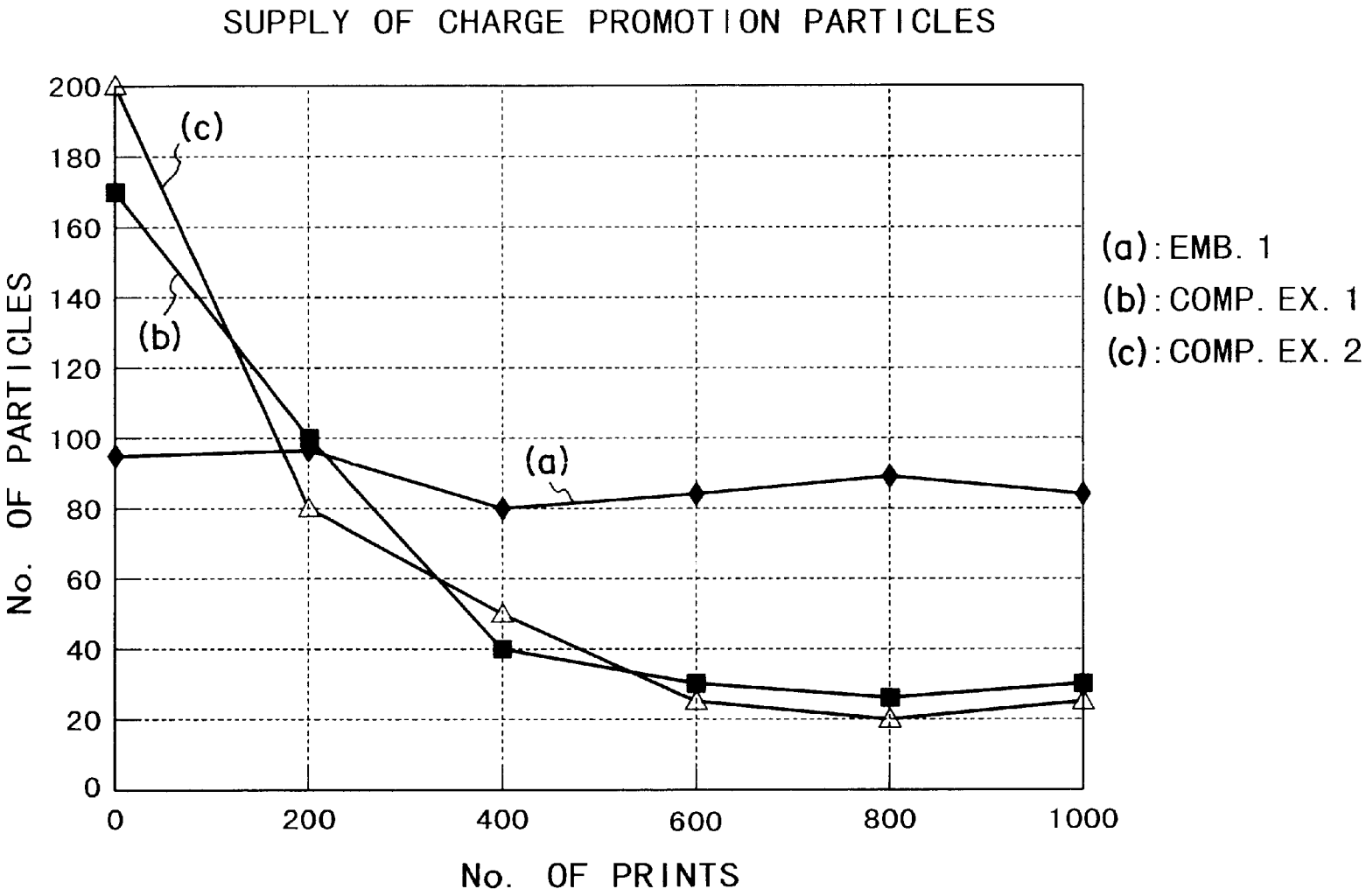
FIG. 3 is a graph which shows changes in the amount of the supplied charging performance enhancing particles.

In FIG. 3, the measured suppliance balances for the charging performance enhancing particles m are shown, in which lines (a), (b) and (c) represent this embodiment, the first comparative example, and the second comparative example, correspondingly. The number of the charging performance enhancing particles m in FIG. 3 represents the number of the charging performance enhancing particles m in 5 $m^2$.

In the case of the first comparative example, the potential level difference for supplying the developer 31 (difference in the "dark" potential direction, between the maximum potential level of the development bias i.e., a DC voltage, and the potential level of the exposed portions of the photosensitive member 1, represented by an arrow mark 1 in FIG. 2), and the potential level difference for supplying the charging performance enhancing particles m (difference of the "dark" potential direction between the minimum potential level of the development bias, i.e., the DC voltage, and the potential level of the "dark" portions of the photosensitive member 1) are substantially equal.

Under a condition such as the one described above, the charging performance enhancing particles m are excessively supplied during the initial period as depicted by a line (b) in FIG. 3. Therefore, the number of the charging performance enhancing particles m on the development sleeve 32 of the developing apparatus 3 decreases, resulting in a decrease in the number of the charging performance enhancing particles m supplied to the peripheral surface of the photosensitive member 1.

If the integral average value of the development bias is changed in order to prevent the charging performance enhancing particles m from being excessively supplied during the initial period, that is, in order to reduce the number of the charging performance enhancing particles m supplied during the initial period, the problems related to the change occur. For example, development density becomes excessively high or the amount of fog increases. Further, if the peak-to-peak votlage of the development bias is decreased for the same purpose, the problems related to the decrease occur; for example, development density becomes low, and/or irregular.

Also in the case of the comparative example 2, the potential level difference 2 for supplying the charging performance enhancing particles m is greater than the potential level difference 1 for supplying the developer 31 as shown in FIG. 2, (*c*). Therefore, the charging performance enhancing particles m are excessively supplied during the initial period.

On the contrary, in the case of this first embodiment, the potential difference 2 for supplying the charging performance enhancing particles m is smaller compared to the potential difference 1 for supplying the developer 31 as shown in FIG. 2, (*a*). Therefore, it does not occur that the charging performance enhancing particles m are excessively supplied during the initial period. Thus, according to this first embodiment, the charging performance enhancing particles m were stably supplied as depicted by line (a) in FIG. 3. Further, the integral average value is adjusted by imposing a certain duty upon the bias. Therefore, it does not occur that the developer 31 is excessively supplied.

The duty imposition allows the peak-to-peak voltage of the development bias to be optionally set, making it easier to satisfy both the suppliance balance for the charging performance enhancing particles m, and the development condition.

As described above, in this embodiment, the balance between the amount of the developer and charging performance enhancing particles m supplied from the developing apparatus 3 is adjusted by adjusting the integral average vale of the development bias by imposing upon the development bias a duty in which the length of the time the potential level of the development bias is at the level at which the charging performance enhancing particles m are supplied from the developing apparatus 3 to the peripheral surface of the photosensitive member 1 during a single cycle of the development bias is greater than 50% of the duration of the single cycle of the development bias, and the potential level difference for enhancing the charging performance enhancing particle suppliance during this period is smaller than the potential level difference for enhancing the developer suppliance. Therefore, the amount of the charging performance enhancing particles m supplied from the developing apparatus 3 could be kept constant.

EMBODIMENT 2 (FIG. 4)

Figure 4:
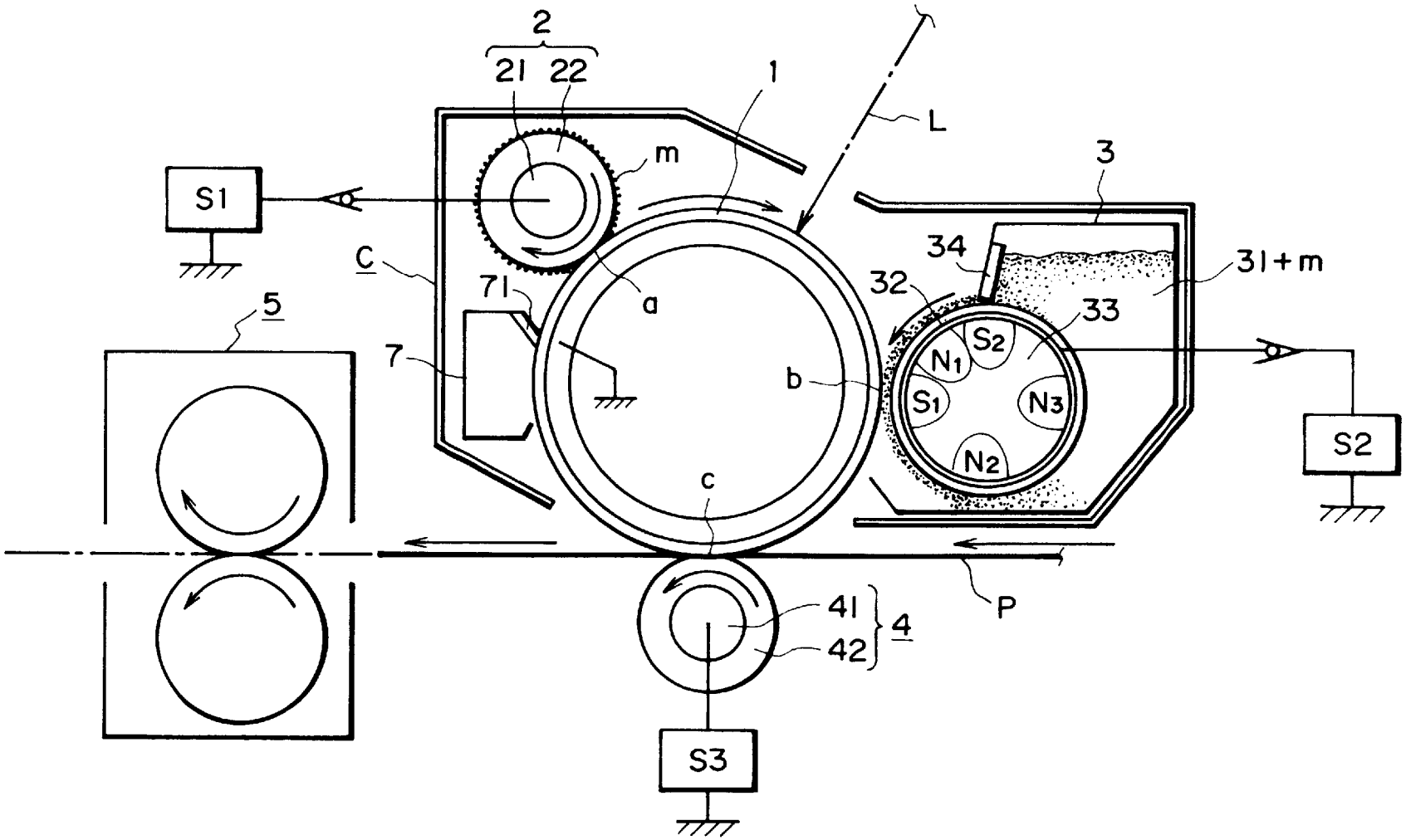
FIG. 4 is a schematic sectional view of the image forming apparatus in the second embodiment.

The printer in this embodiment, illustrated in FIG. 4, is similar in structure to the above-described printer in the first embodiment (FIG. 1), except that the printer in this embodiment is provided with a cleaning apparatus 7 (cleaner) for cleaning the peripheral surface of the photosensitive member 1, more specifically, for removing the transfer residual developer, paper dust, and the like from the peripheral surface of the photosensitive member 1 after image transfer, at a location between the transfer station c and charging nip a, in addition to the components with which the printer in the first embodiment is provided. Therefore, the repetition of the same description will be omitted.

The cleaning apparatus 7 in this embodiment is a cleaning apparatus which uses a cleaning blade 71 for cleaning the photosensitive member 1. The cleaning blade 71 is an elastic blade formed of urethane rubber. The major portion of the developer and paper dust which remains on the peripheral surface of the photosensitive member 1 after image transfer is removed from the peripheral surface of the photosensitive member 1 by pressing the cleaning blade 7 upon the peripheral surface of the photosensitive member 1.

Therefore, in the image forming apparatus in this embodiment, the amount of the transfer residual developer and paper dust which are carried to the charging nip a is remarkably small compared to that in the image forming apparatus in the first embodiment. Thus, the amount of the transfer residual developer and paper dust which mix into the particles ion the charge roller 2 or adhere to the charge roller 2 is remarkably small. Therefore, the image forming apparatus in this embodiment is superior in charging performance, and is stable in image quality.

It should be noted here that the cleaning blade 71 is pressed upon the peripheral surface of the photosensitive member 1 with the application of such an amount of pressure that allows the charging performance enhancing particles m, which are smaller in particle diameter than the toner and paper dust which remain on the peripheral surface of the photosensitive member 1 after image transfer, to slip by the cleaning blade 71.

Thus, even though the cleaning apparatus 7 removes the transfer residual toner, it allows the charging performance enhancing particles m which were mixed into the developer 31 in the developing apparatus 3, were supplied to the peripheral surface of the photosensitive member 1, and adhered to the peripheral surface of the photosensitive member 1, to pass the cleaning apparatus 7. As a result, the charging performance enhancing particles m are carried to the charging nip a past the transfer station c as the peripheral surface of the photosensitive member 1 moves. In the charging nip a, the charging performance enhancing particles m are automatically supplied to the charge roller 2 and maintain the charging performance at an excellent level.

Further, the charging performance enhancing particles m are present between the cleaning blade 71 and the peripheral surface of the photosensitive member 1 in the contact area between the cleaning blade and the photosensitive member 1. Therefore, it does not occur that the edge portion of the cleaning blade 71 buckles and is dragged underneath itself into the nip between the cleaning blade 71 and the photosensitive member 1 by the friction between the cleaning blade 71 and the photosensitive member 1, or that the rotational velocity of the photosensitive member 1 is made irregular by the friction. Therefore, it is possible to obtain excellent images.

More specifically, in the past, if the peripheral surface of the photosensitive member 1 was inferior in slipperiness when the cleaning apparatus 7 which employed the cleaning blade 71 was used, it sometimes occurred that the free edge portion of the cleaning blade 7 buckled and was dragged underneath itself into the interface between itself and the photosensitive member 1, or that the rotational velocity of the photosensitive member 1 became irregular. In this embodiment, however, the charging performance enhancing particles m which adhered to the peripheral surface of the photosensitive member 1 are present between the cleaning blade 71 and the photosensitive member 1. Therefore, the peripheral surface of the photosensitive member 1 is better in slipperiness. Thus, it does not occur that the free edge portion of the cleaning blade 71 buckles and is dragged underneath itself into the interface between the cleaning blade 71 and the photosensitive member 1 by the friction between the cleaning blade 71 and the photosensitive member 1.

Miscellaneous

1) The choice of the charge roller 2 as a flexible contact type charging member does not need to be limited to the charging rollers described in the preceding embodiments.

In addition to the above described charge roller 2, a fur brush based charging device may be used as a flexible contact type charging device. In other words, a contact type charging member different in material and shape may be employed as a flexible contact type charging member; for example, a piece of felt, a piece of fabric, or the like. Further, these members may be employed in combination to obtain better elasticity and electrical conductivity.

2) An injection charge system in a contact type charging process is seriously affected by the state of contact between a contact type charging member and an object to be charged. Therefore, a contact type charging member is made as high as possible in density, and is structured so that as large as possible difference in peripheral velocity, and as frequent as possible electrical contacts, are provided between the contact type charging member and an object to be charged.

Further, it is possible to make the charge injection mechanism a dominant factor in the contact type charging process by adjusting the electrical resistance of the surface layer of an object to be charged, with the provision of a charge injection layer as the surface layer of the object to be charged.

Figure 5:
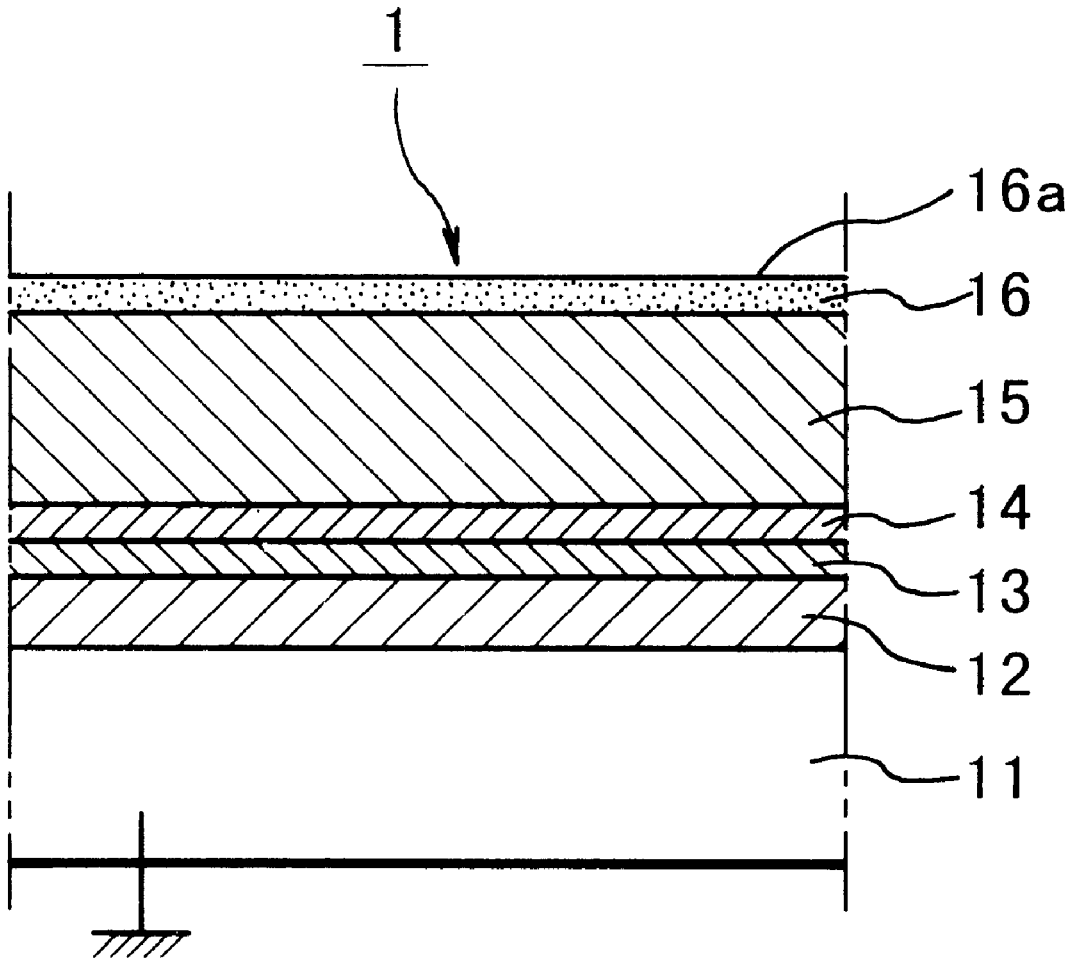
FIG. 5 is a schematic sectional view of the peripheral portion of an example of a photosensitive member, the surface layer of which is a charge injection layer.
Figure 6:
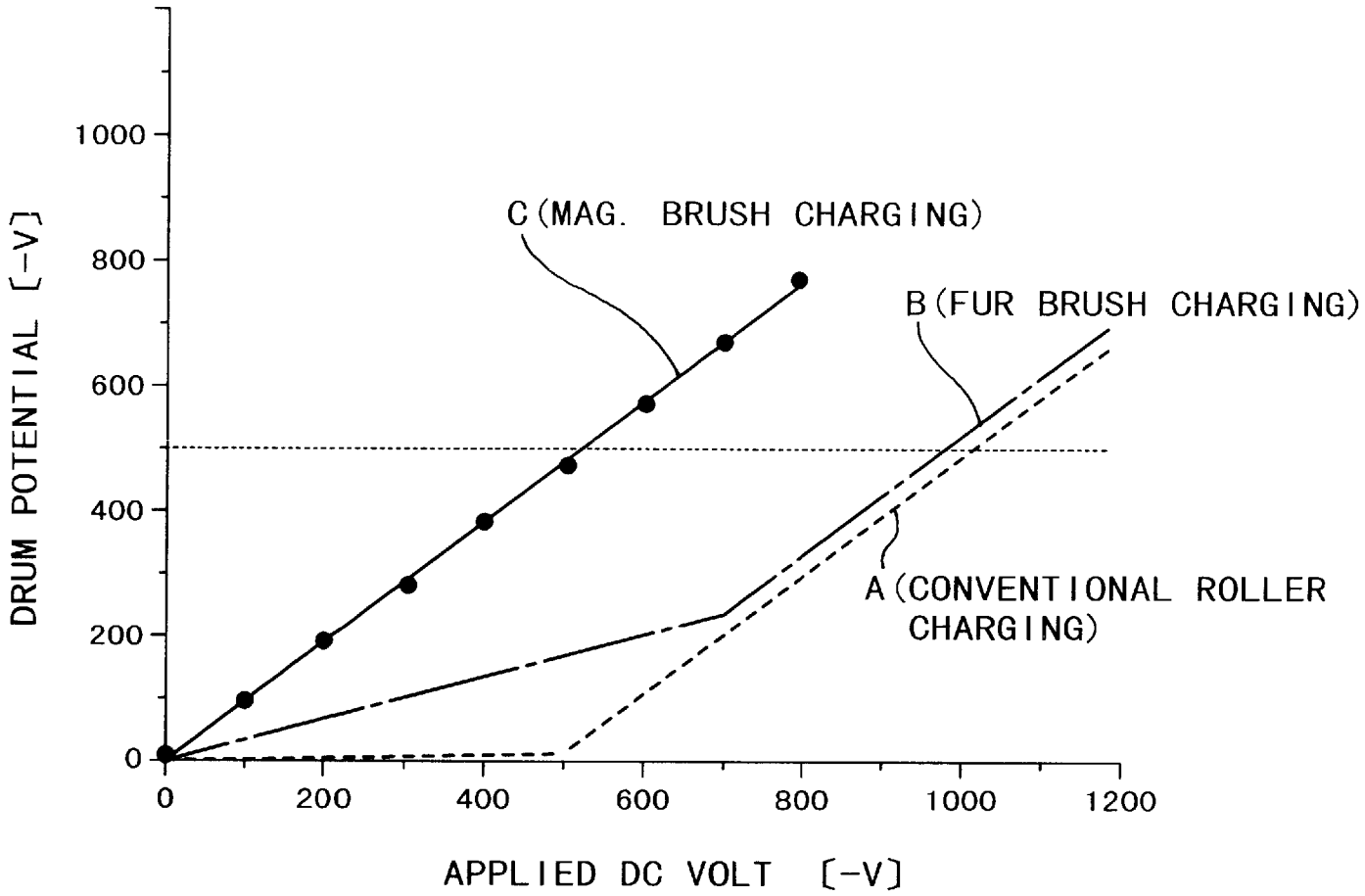
FIG. 6 is a graph which shows the characteristics of various contact type charging members.

FIG. 5 is a schematic sectional view of the peripheral portion of a photosensitive member 1, the surface layer of which is a charge injection layer 16. It shows the peripheral structure of the photosensitive member 1. The photosensitive drum 1 is a photosensitive drum crated by coating a charge injection layer 16 on the peripheral surface of an ordinary organic photosensitive drum which comprises a base member 11 (aluminum drum) and four functional layers: an undercoat layer 12, a positive charge injection prevention layer 13, a charge generation layer 14, and a charge transfer layer 15, which are coated in layers in this order on the base member 11. The charge injection layer 16 is coated to improve the performance of an ordinary organic photosensitive member.

The material for the charge injection layer 16 is provided by dispersing microscopic particles 16*a* (approximately 0.03 $\mu$m in diameter) of $SnO_2$, that is, electrically conductive particles (electrically conductive filler), lubricant such as tetrafluoroethylene (commercial name: Teflon), polymerization initiating agent, and the like, into optically curable acrylic resin, that is, binder. This material is coated and optically cured into thin film.

The important aspect of the charge injection layer 16 is the surface resistance of its surface layer. In a charging system based on a direct charge injection principle, reducing the electrical resistance on the side of an object to be charged enhances the efficiency with which electrical charge is exchanged. On the other hand, when an object to be charged is a photosensitive member, it is required to sustain an electrostatic latent image for a certain length of time. Thus, the proper range for the volumetric resistivity of the charge injection layer 16 is $1\times10^{9}$–$1\times10^{14}$ (ohm.cm).

Further, even if a photosensitive member is not provided wit the charge injection layer unlike the photosensitive member described above, the same effects as described above can be obtained if the electrical resistance of the charge transfer layer 15 is within the aforementioned range.

The same effects can also be obtained by employing an amorphous silicon based photosensitive member which is approximately $10^{13}$ ohm.cm in the volumetric resistivity of its surface layer.

3) When an alternating voltage (AC voltage) is included as a component in the bias applied to the contact type charging member 2, development apparatus, or the like, the wave-form of the AC voltage is optional: it may be sinusoidal, rectangular, triangular, or the like. The bias may be an alternating voltage with a rectangular wave-form, which is generated by periodically turning on and off a DC power source. In other words, any votlage which periodically changes in potential level may be used as the aforementioned bias; the wave-form of the alternating voltage is optional.

4) The selection of an exposing means for forming an electrostatic latent image does not need to be limited to a laser based scanning type exposing means, such as the one in the preceding embodiments, which digitally forms a latent image. It may be an ordinary analog type exposing means, a light emitting element such as an LED, a combination of a light emitting element such as a fluorescent light and a liquid crystal shutter, or the like. In other words, any exposing means may be employed as long as it can form an electrostatic latent image in accordance with image formation data.

5 ) The image bearing member may be an electrostatically recordable dielectric member or the like. In this case, an electrostatic latent image of an original is written on the surface of a dielectric member by removing electrical charge from selected points of the surface of the dielectric member with the use of a charge removing means such as a charge removing head, an electron gun, or the like, after the surface of the dielectric member is uniformly charged (primary charge) to predetermined polarity and potential level.

It is also a matter of course that the developing apparatus 3 is not limited in developing system and structure to those in the preceding embodiments. For example, the development means may be of a contact type, and also may be of a type which employs a normal development process.

6) A recording medium which receives a developer image (image of developer) from the image bearing member 1 may be an intermediary transfer member such as a transfer drum.

7) The following is one example of a method for measuring the particle size of the developer 31 (toner). As for a measuring apparatus, Coulter Counter TA-2 (Coulter Co.) is used, to which an interface (Nikkaki) which outputs number average distribution and volumetric average distribution, and a personal computer (CX-1: Canon), are connected. As for electrolyte, 1% solution of NaCl is prepared using first class sodium chloride.

As for a measuring method, 0.1–5 ml of surfactant, in particular, alkyl benzene sodium sulfonate, is added as dispersant into 100–150 ml of the aforementioned water-based electrolyte, and then, 0.5–50 mg of test sample is added.

The electrolyte in which the test sample is suspended is subjected to a supersonic dispersing device for approximately 1–3 minutes to disperse the test sample. Then, the size distribution of the particles with a diameter in a range of 2–40 $\mu$m, is obtained with the use of the aforementioned Coulter Counter TA fitted with a 100 $\mu$m aperture. From the thus obtained particle size distribution, the volumetric average distribution of the test sample is obtained, and from this, the volumetric average particle diameter of the test sample is obtained.

While the invention has been described with reference to the structures disclosed herein, it is not confined to the details set forth and this application is intended to cover such modifications or changes as may come within the purposes of the improvements or the scope of the following claims.

What is claimed is:

1. An image forming apparatus comprising:

an image bearing member;

charging means for charging said image bearing member;

image forming means for forming an electrostatic image on said image bearing member charged by said charging means;

developing means for developing the electrostatic image on said image bearing member and for supplying to said image bearing member a toner and charging performance enhancing particles having a polarity opposite from that of the toner;

wherein said developing means has a developer carrying member, opposed to said image bearing member, for carrying the toner and the charging performance enhancing particles and forms an alternating electric field between said developer carrying member and said image bearing member to supply the toner and the charging performance enhancing particles to said image bearing member; and wherein a time duration of supplying the charging performance enhancing particles is longer than a time duration of supplying the toner, in one period of the alternating electric field.

2. An apparatus according to claim 1, wherein an intensity of the alternating electric field in the time duration of supplying the toner is higher than that of in the time duration of supplying the charging performance enhancing particles.

3. An apparatus according to claim 1, wherein said charging means includes a charging member contacted to said image bearing member, and the charging performance enhancing particles are supplied to said charging member by rotation of said image bearing member.

4. An apparatus according to claim 3, wherein said charging member has a foam member capable of retaining the charging performance enhancing particles.

5. An apparatus according to claim 3, wherein said charging member is movable with a speed difference relative to said image bearing member.

6. An apparatus according to claim 1, further comprising transfer means for transferring a toner image from said image bearing member onto a transfer material, wherein said charging means charges a surface of said image bearing member from which residual toner after image transfer is not removed.

7. An apparatus according to claim 1, wherein the charging performance enhancing particles have a resistance of not more than $10^{12}$ Ohm.cm.

8. An apparatus according to claim 1, wherein the charging performance enhancing particles have an average particle size of not more than one half a particle size of the toner.

9. An apparatus according to claim 1, wherein said image bearing member has a surface layer containing electroconductive particles.

10. An apparatus according to claim 9, wherein the surface layer has a volume resistivity $10^{9}$–$10^{14}$ Ohm.cm.

11. An apparatus according to claim 1, wherein said image bearing member includes a photosensitive member, and said image forming means includes an exposure light source for exposing said image bearing member to image light.

* * * * *

UNITED STATES PATENT AND TRADEMARK OFFICE

CERTIFICATE OF CORRECTION

PATENT NO. : 6,173,144 B1
DATED : January 9, 2001
INVENTOR(S) : Jun Hirabayashi et al.

It is certified that error appears in the above-identified patent and that said Letters Patent is hereby corrected as shown below:

Sheet 2,
Fig. 2 (a), "CHAREE" should read -- CHARGE --.

Column 2,
Line 20, "It" should read -- is --.

Column 3,
Line 67, "charge" should read -- charged --.

Column 6,
Line 58, "application" should read -- Application --.

Column 10,
Line 13, "is" should read -- it is --.
Line 14, "53." should read -- S3. --.
Line 30, "and," should read -- end, --.
Line 38, "transfer" should read -- transfer medium P. Then, the transfer medium P is discharged --.

Column 11,
Line 62, "is" should read -- are --.

Column 12,
Line 29, "10 ohm.cm," should read -- $10^{12}$ohm.cm, --.

Column 16,
Line 13, "votlage" should read -- voltage --.
Line 58, "Apparatus 3" should read -- Apparatus 3. --.

Column 19,
Line 28, "votlage" should read -- voltage --.
Line 60, "vale" should read -- value --.

Column 21,
Line 58, "crated" should read -- created --.

UNITED STATES PATENT AND TRADEMARK OFFICE

CERTIFICATE OF CORRECTION

PATENT NO. : 6,173,144 B1
DATED : January 9, 2001
INVENTOR(S) : Jun Hirabayashi et al.

It is certified that error appears in the above-identified patent and that said Letters Patent is hereby corrected as shown below:

Column 22,
Line 20, "wit" should read -- with --.
Line 35, "votlage" should read -- voltage --.

Signed and Sealed this

Thirteenth Day of November, 2001

*Attest:*

Nicholas P. Godici

NICHOLAS P. GODICI
*Acting Director of the United States Patent and Trademark Office*

*Attesting Officer*